US005090457A

United States Patent [19]

Corain et al.

[11] Patent Number: 5,090,457

[45] Date of Patent: Feb. 25, 1992

[54] ELECTRO MAGNETIC WEFT SELECTION DEVICE

[75] Inventors: Luciano Corain; Gianni Maitan, both of Venice; Luigi Corazzola, Tres, all of Italy

[73] Assignee: Nuovopignone-Industrie Meccaniche e Fonderia S.p.A., Florence, Italy

[21] Appl. No.: 542,812

[22] Filed: Jun. 22, 1990

[30] Foreign Application Priority Data

Jun. 30, 1989 [IT] Italy ..... 21036 A/89

[51] Int. Cl.[5] ..... D03D 47/38

[52] U.S. Cl. ..... 139/453

[58] Field of Search ..... 139/453, 455

[56] References Cited

U.S. PATENT DOCUMENTS 4,438,791 3/1984 Oesterle et al. ..... 139/453
4,556,089 12/1985 Juillard ..... 139/453
4,852,618 8/1989 Zollinger et al. ..... 139/453

*Primary Examiner*—Andrew M. Falik
*Attorney, Agent, or Firm*—Morgan & Finnegan

[57] ABSTRACT

Device for selection and presentation of the weft yarns for high-speed looms, in which the mechanism of selection of the weft yarns comprises a set of collars, each equipped with an iron armature. The collars are slid through a free end of selectors and cooperate with a transverse lifting beam as well as with a corresponding set of permanent magnets equipped with a coil in order to nullify the magnetic field generated by the same magnet.

2 Claims, 5 Drawing Sheets

ELECTRO MAGNETIC WEFT SELECTION DEVICE

The present invention relates to a novel device of selection and presentation of the weft yarns. The novel device eliminates the use of program-controlled feeler needles and reduces the moving parts and consequently the number and energy value of the impacts. This enables a rational, effective, reliable and cheap operation of the device to be accomplished even at such high speeds as required by the modern looms.

BACKGROUND OF THE INVENTION

Several types of devices of selection and presentation of the weft yearns are already known.

According to one of these prior art devices a set of fingers, through whose eyelets the several weft yarns run, are hinged onto a corresponding set of actuation levers. The actuation levers are urged by a respective return spring against a stroke limit and are angularly moved by a corresponding set of selectors hinged to them. The selectors are urged by a respective return spring against a corresponding set of feeler needles of the weft yarns selection mechanism. The selectors can be shifted by a transverse oscillating beam supported by a cam-driven "L"-shaped lever which is urged against said cam by a return spring and cooperates with suitable appendices provided on all of said selectors. A further transverse beam is provided at the end of another—also cam-driven and spring returned—lever in order to simultaneously lift all of the selectors at each selection cycle.

In the presence of a selection hole in the perforated-tape or hole-closing-electromagnet mechanical program, the relevant feeler needle penetrates said hole, consequently moving downwards. Due to the effect of its return spring, the respective selector moves downwards and comes thus to a position in which it interferes with the movement of said oscillating beam. Such an interference will cause an oscillation of the same selector, and consequently of the respective actuation lever to take place, consequently causing an angular shift of the relevant arrow which will present its own, so selected, weft yarn, to the weft inserter organ.

Unfortunately, such a structure suffers from a plurality of mechanical drawbacks which are substantially due to the weft yarns selection mechanism The weft yarn selection mechanism with its feeler needles shows a poor precision at high speeds, and is extremely sensitive to dust, to moisture and to all changes in atmospheric conditions, which may cause the blocking thereof. On the other hand, said selection mechanism, with its moving parts, is subject to considerable wear and a consequent short useful life.

SUMMARY OF THE INVENTION

The purpose of the present invention is of obviating the above said drawbacks and to provide a device of selection and presentation of the web yarns, which employs a weft yarns selection mechanism which does not use feeler needles and contains reduced moving parts.

This objective is substantially achieved in that the free end of each selector is coupled with a collar equipped with an iron armature. The collar, in cooperation with said transversal lift beam, is brought into contact with a relevant magnetic means, such as a permanent magnet provided with a winding, to which magnetic means said collar remains magnetically attached, thus keeping the respective selector in its lifted position. The latter is selected and hence lowered by simply causing an electrical current of a precise value which is suitable for nullifying the magnetic field generated by the same magnetic means to flow through said winding provided on said magnetic means.

In such a way, the device no longer contains mobile elements (i.e., the needles) which have to penetrate holes. Additionally, a considerable reduction is achieved in the moving parts, because at each cycle the only moved element is the selected element, with all of the other elements remaining stationary. The number and energy of impacts, and therefore the wear, of the various elements, is consequently reduced. The required energy is minimized since the only strictly necessary energy is for nullifying the magnetic element of the only selected element.

Summing up, the present device of selection and presentation of the weft yarns for high-speed looms comprises a set of fingers which are hinged to a corresponding set of actuation levers that are angularly moved by a corresponding set of selectors. The actuation levers are elastically urged against a selection mechanism and are moved via an oscillating element. According to the present invention, the selection mechanism comprises a set of collars each of which are equipped with an iron armature and which slidingly support the free end of the selectors and cooperate with a corresponding set of permanent magnets. Each permanent magnet is equipped with a respective winding with which permanent magnet said collars are brought into contact and remain magnetically attached in a lifted position, by the transverse lifting beam. The selection and, hence, the lowering of a selector is achieved by nullifying the magnetic field generated by the respective permanent magnet by causing an electrical current with a precise value of intensity, and in a well defined flowing direction to flow through said winding.

According to a variant of the present invention, the collars are equipped with a magnetic armature and cooperate with electromagnets suitable for generating a magnetic field whose polarity is opposite to the polarity of said armatures.

In this case, it is no longer required that the electrical current is of a specific, exact value necessary to nullify the magnetic field generated by the permanent magnet. The value of said electrical current can be further reduced since an extremely small electromagnetic field is now necessary in order to repel the magnetic armature of the collars.

The invention is better understood by referring to the hereto attached drawings. The drawings illustrate a preferred form of practical embodiment and are given for exemplifying purposes, and in no way should be construed as being limitative of the present invention. Technical, technological or structural variants may always be supplied without departing from the scope of the same invention.

Figure 2:
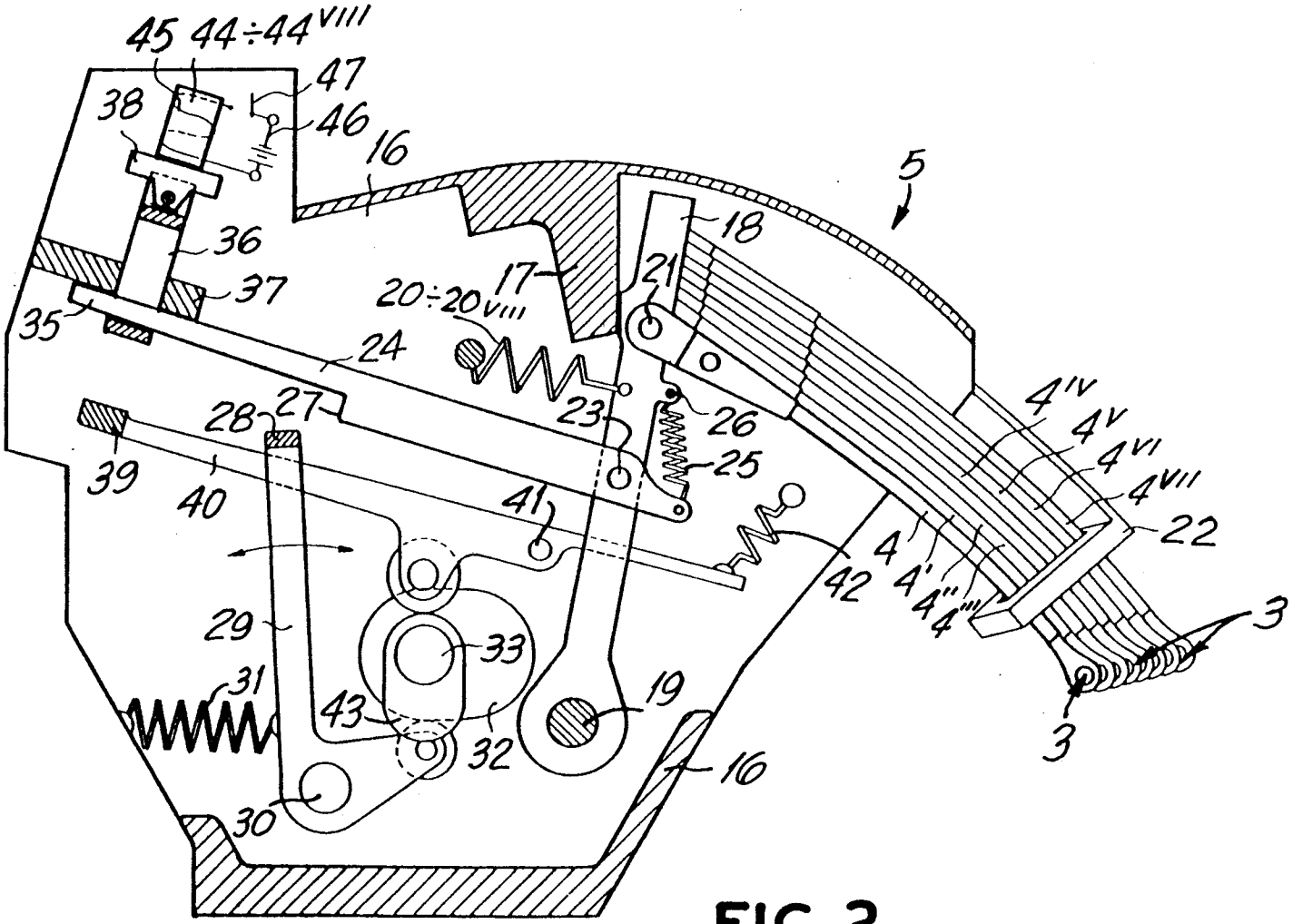
FIG. 2 shows a side sectional, enlarged-scale view of the weft yarns selection and presentation device of FIG.
Figure 3:
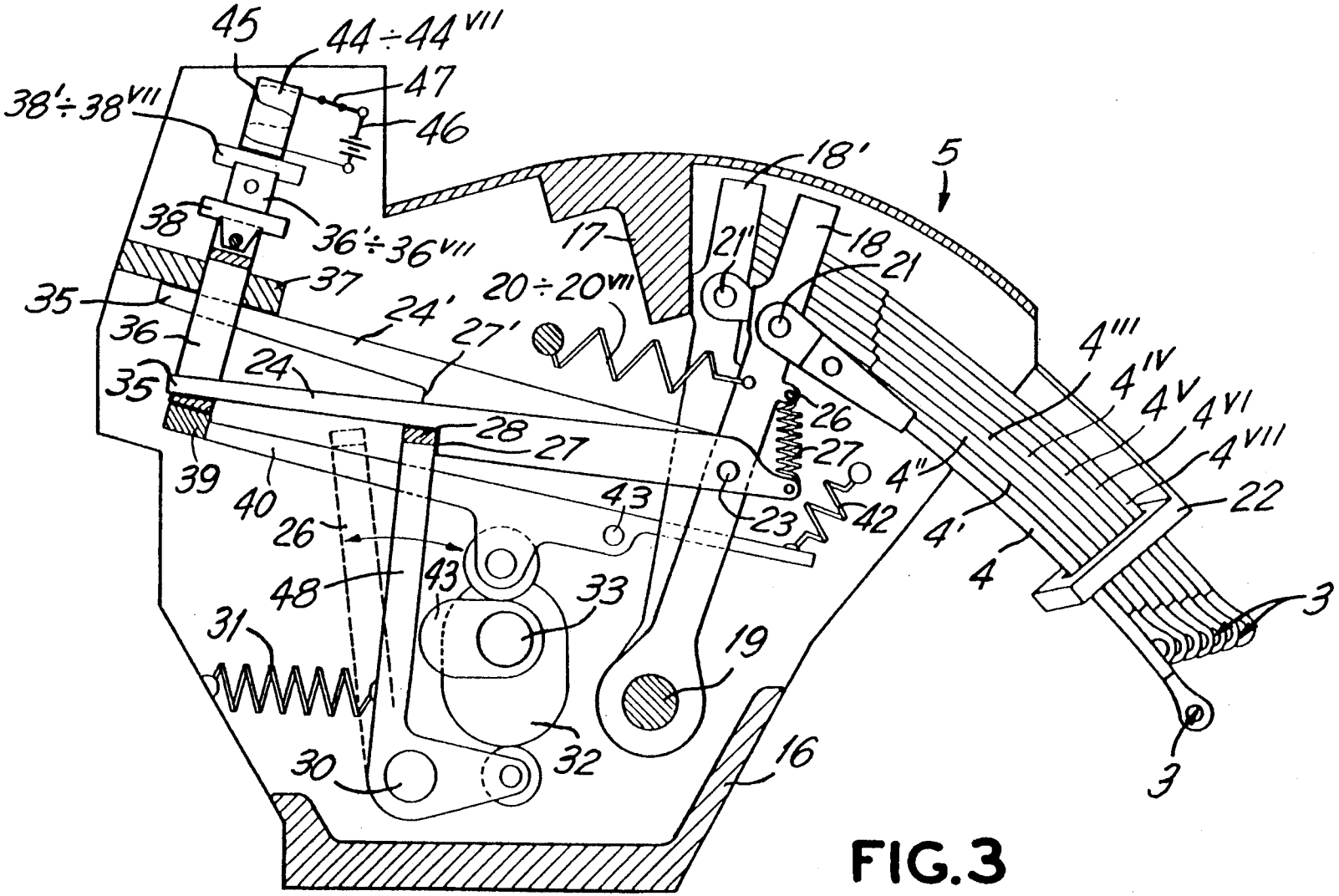
Figure 4:
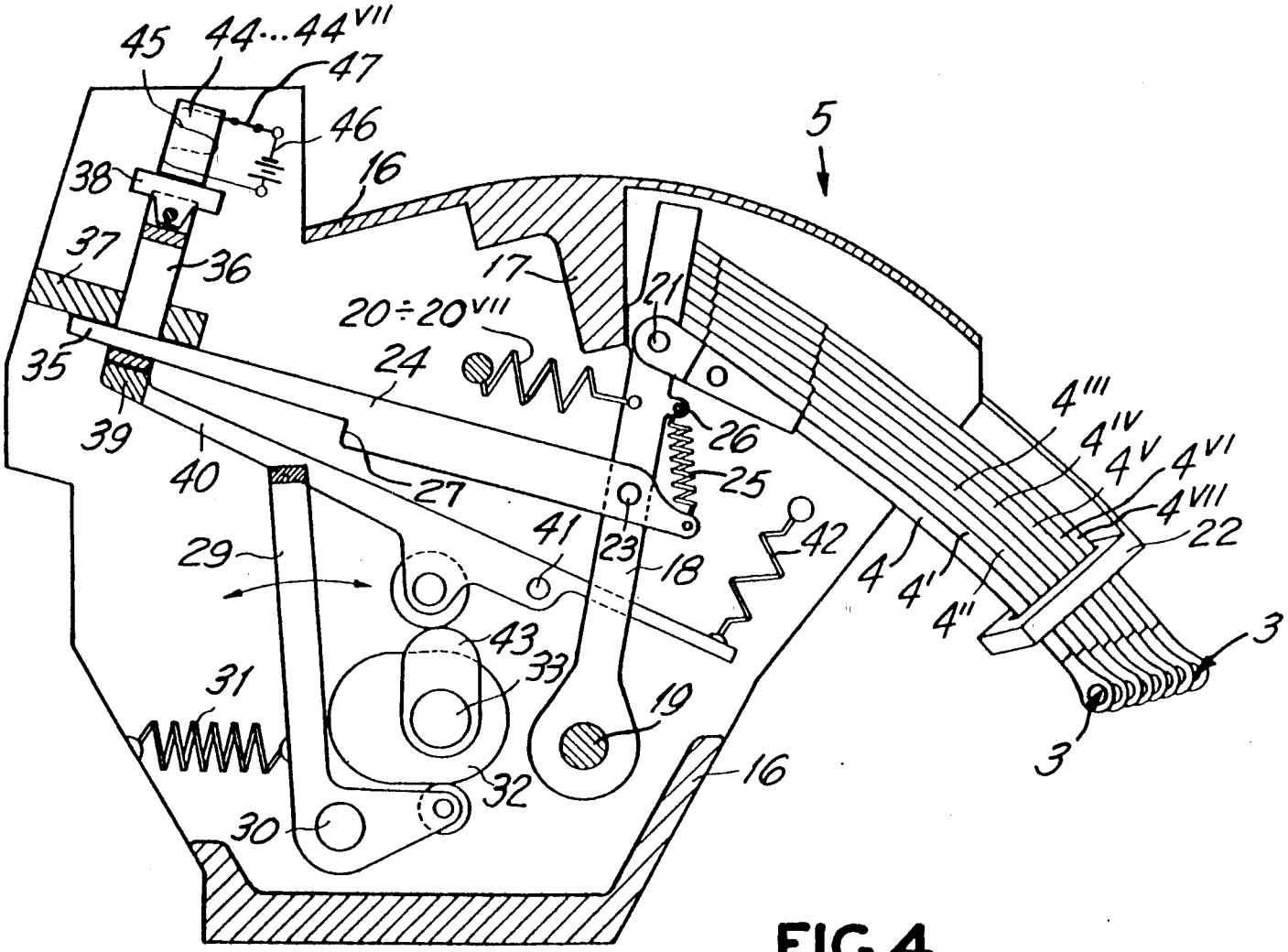
Figure 5:
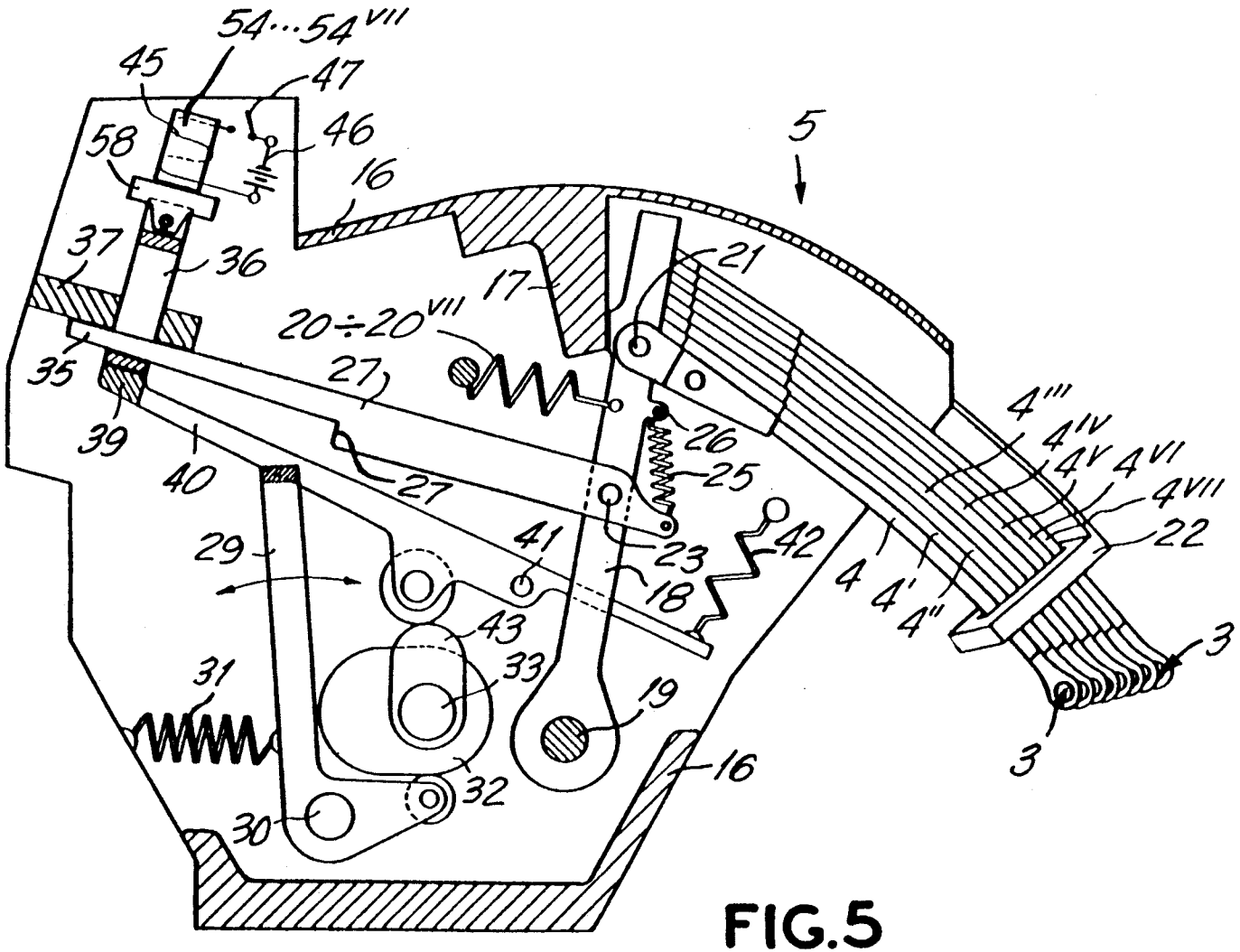

1, during the initial step of the selection cycle with all of the fingers being in their lifted position;

FIG. 3 shows a view analogous to the view of FIG. 2, during the step of selection and presentation of a finger;

FIG. 4, shows a view analogous to the view of FIG. 3, during the step of selection cycle end, when the selected finger is caused to return back to its resting position, and the relevant selector has been lifted by the lifting beam. FIG. 5 shows a variation of the device shown in FIG. 2.

DETAILED DESCRIPTION OF THE DRAWINGS

Figure 1:
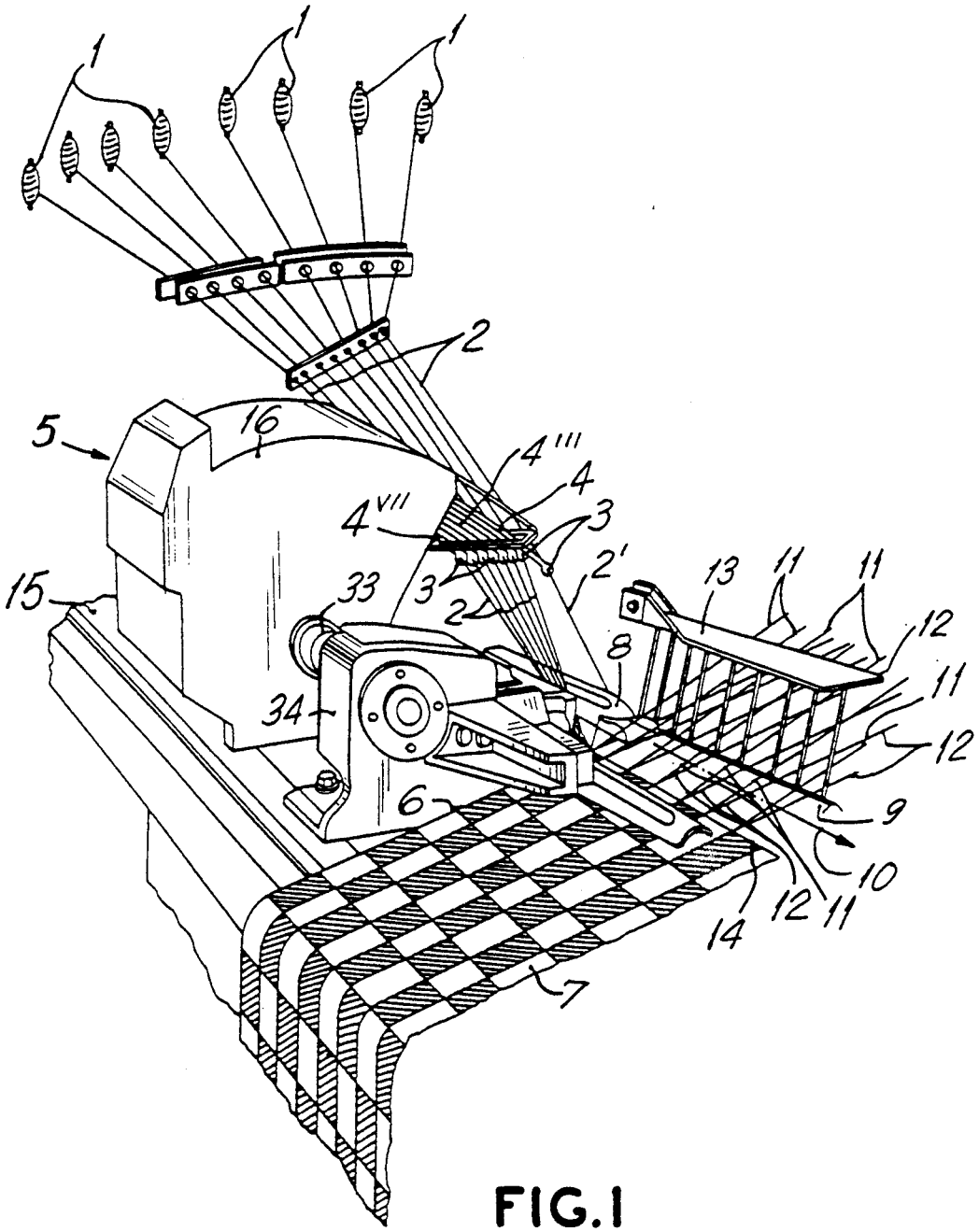
FIG. 1 shows a partial perspective view of the left-hand end of a loom wherein the weft yarns selection and presentation device according to the present invention is shown.

Referring to the figures, the stationary bobbins 1 are shown in schematic form, from which the weft yarns 2 are drawn and run through the eyelets 3 of the fingers 4, $4^{i}$, $4^{ii}$, . . . $4^{vii}$ of the selection and presentation and device 5 remain sticking to the side edge 6 of the cloth 7. When the weft yarn $2^{i}$ is presented, the lowering of the respective finger 4 (see FIG. 1), in front of the weft inserter 8, the yarn is hooked by this latter and, dragged by the movement of the weft inserter onto the slay 9 of the loom in the stroke direction 10, is inserted inside the open shed formed by the warp yarns 11 and 12, and is picked by the comb or reed 13 against the front edge 14 of the fabric 7.

The selection and presentation device 5 is fastened onto the breast beam 15 of the loom on the left-hand end thereof, and comprises a case 16 having within its interior an inwardly protruding portion 17 which constitutes a stroke limit for a set of actuation levers 18, $18^{i}$, . . . $18^{vii}$ (in FIG. 3 only two of these levers are visible, in that the residual six levers are overlapping with $18^{i}$). Said shaft 19 supported by the case 16 and are respectively urged against said protruding portion 17 by springs 20, $20^{i}$, . . . $20^{vii}$ (only the first spring is visible in the figures; the residual seven springs are overlapping) and have hinged to them by means of the pivots 21, $21^{i}$, . . . $21^{vii}$, fingers 4, $4^{i}$, . . . $4^{vii}$ which are guided in their lowering movement by a guide box 22 which is solidly affixed to the case 16.

The selectors 24, $24^{i}$, . . . $24^{vii}$ are hinged onto said actuation levers 18, . . . $18^{vii}$ by means of respective pivots 23. Said selectors 24, $24^{i}$, . . . $24^{vii}$ are urged downwardly by springs 25 acting between an end of the same selector, and anchoring 26 purposely provided on the relevant actuation lever. Each selector 24, $24^{i}$, . . . $24^{vii}$ is provided with a shoulder 27, $27^{i}$, . . . $27^{vii}$ suitable for cooperating with the oscillating transverse beam 28. Transversal beam 28 is supported by an "L"-shaped lever 29, which is hinged at 30 and is constantly kept by a spring 31 into contact with a cam 32 driven by the driving shaft 33. Driving shaft 33 also actuates the cutting device 34 of the loom (see FIG. 1).

A collar 36, $36^{i}$, . . . $36^{vii}$ is slid onto the free end 35 of each selector 24, . . . $24^{vii}$ and said collar being guided by a guide block 37 and is equipped with an iron armature 38, $38^{i}$, . . . $38^{vii}$ hinged thereto. The collar cooperates with a further transverse lifting beam 39 provided at the end of another lever 40 which is hinged at 41 and which is kept urged by a spring 42 against a second cam 43 integral with said driving shaft 33, as well as with a permanent magnet, respectively 44, $44^{i}$, . . . $44^{vii}$. A winding 45 is provided which can be closed on its own demagnetizing circuit 46 through the switch 47 governed by electronic programmer, not shown in the figures.

The device according to the present invention operates as follows.

At the beginning of the selection cycle all of the switches 47 are open and all of the collars 36, . . . $36^{vii}$, lifted by the transverse lifting beam 39 due to the effect of the cam 43, have their iron armatures $38^{i}$, . . . $38^{vii}$ magnetically hooked to the relevant permanent magnets 44, . . . $44^{vii}$ and hence keep the respective selectors 24, . . . $24^{vii}$ out of the oscillation range of action of the oscillating transverse beam 28, as shown in FIG. 2.

When, for example, the finger No. 4 has to be selected, the electronic programmer closes the relevant switch 47 causing the de-magnetization of the magnet 44 to take place and liberates the collar 36. Due to the effect of the spring 25, collar 36 moves downwardly together with the relevant selector 24 which will thus enter within the range of action of the transverse beam 28. By oscillating from its position shown in broken lines as indicated by the reference numeral 29 in FIG. 3 to its position shown in solid lines and indicated with the reference numeral 48, transverse beam shifts to the right the same selector by acting on the shoulder 27 of this latter, thus causing the actuation lever 18 to rotate clockwise and the finger 4 (see still FIG. 3) to be lowered.

Thereafter, the end step of the selection cycle is performed. Due to the effect of the cam 32 and of the spring 31, the transverse beam 28 returns backwards together with the lever 18 and with the arrow 4 due to the effect of the spring 20, after which the selector 24 and the relevant collar 36 are lifted by the transverse lifting beam 39 by the effect of the cam 43 (see FIG. 4), and the switch 47 is opened, with the starting conditions shown in FIG. 2 being thus restored.

Finally, according to a variant of the invention shown in FIG. 5, which does not substantially modify the operation of the present invention, said armatures 58, $58^{i}$, . . . $58^{vii}$ of said collars 36, $36^{i}$, . . . $36^{vii}$ are magnetic and 54, . . ., $54^{vii}$ are electromagnets, whose energizing circuits 46 are used to generate a magnetic field with a polarity opposite to the polarity of said magnetic armatures.

We claim:

1. A device for selection and presentation of weft yarns for high-speed looms, which device comprises a set of fingers having eyelets through whose eyelets the weft yarns run, which set of fingers are hinged to a corresponding set of actuation levers which are angularly moved by a corresponding set of selectors, said selectors being elastically urged against a lever means operated by an oscillating element, and a transverse lifting beam being provided in order to simultaneously lift all of said selectors at a selection cycle, said device further including a set of collars for the selectors, said collars being equipped with an iron armature, which collars slidingly support a free end of said selectors and cooperate with a corresponding set of magnetic means each equipped with a respective winding, with which magnetic means said collars are brought into contact by the transverse lifting beam and remain magnetically attached to said magnets in a lifted position, with the selection and hence the lowering of the selector being achieved by nullifying the magnetic field generated by the respective magnetic means by causing an electrical current to flow through said winding.

2. A device for selection and presentation of the weft yarns for high-speed looms according to claim 1, wherein said armatures are magnetic with the selection, and therefore the lowering of a selector being achieved by magnetic repulsion, by creating with the magnetic means a magnetic field of polarity opposite to the polarity of said magnetic armature.

* * * * *